US007955050B1

(12) United States Patent
Wadensten

(10) Patent No.: US 7,955,050 B1
(45) Date of Patent: Jun. 7, 2011

(54) TURBINE WHEEL ASSEMBLY FOR A PNEUMATIC ROTARY VIBRATOR AND METHOD OF MAKING SAME

(76) Inventor: Theodore S. Wadensten, Charlestown, RI (US)

( * ) Notice: Subject to any disclaimer, the term of this patent is extended or adjusted under 35 U.S.C. 154(b) by 75 days.

(21) Appl. No.: 12/460,611

(22) Filed: Jul. 22, 2009

Related U.S. Application Data

(60) Provisional application No. 61/201,895, filed on Dec. 16, 2008.

(51) Int. Cl.
*F01D 1/02* (2006.01)
*F01D 5/10* (2006.01)
*F03B 1/00* (2006.01)

(52) U.S. Cl. ..... 415/202; 415/904; 416/145; 29/889

(58) Field of Classification Search ..... 415/182.1, 415/202, 904; 416/144, 145, 203; 29/889, 29/889.2
See application file for complete search history.

(56) References Cited

U.S. PATENT DOCUMENTS 1,346,221 A * 7/1920 Liedtke ..... 366/124
2,774,244 A * 12/1956 Bergström et al. ..... 74/61
2,818,184 A * 12/1957 Matson ..... 414/375
3,498,651 A * 3/1970 Peterson ..... 403/355
3,870,282 A 3/1975 Wadensten
3,932,057 A 1/1976 Wadensten
3,938,905 A 2/1976 Wadensten
4,333,659 A * 6/1982 Gibbs ..... 277/301
4,435,083 A * 3/1984 Matson ..... 366/114
4,604,029 A 8/1986 Fink
6,354,744 B1 * 3/2002 Henn ..... 384/564
6,966,751 B2 11/2005 Masterson et al.

* cited by examiner

*Primary Examiner* — Edward Look
*Assistant Examiner* — Sean J Younger

(57) ABSTRACT

An apparatus and method for a turbine wheel assembly for a pneumatic rotary vibrator that provides a selectable force output while being removably retained on a vibrator shaft member. The turbine wheel assembly is mounted inside of a generally circular interior chamber of a pneumatic vibrator housing. The turbine wheel assembly includes: (1) a turbine ring that has an outside diameter, an inside diameter and a face width, (2) a sleeve member that is round and tubular, (3) an intermediate weight ring assembly that has an outer circumference, an inner circumference, and a predetermined face width, The weight ring assembly is formed by a plurality of wedge shaped segments. The plurality of wedge shaped segments include a predetermined quantity of heavy material segments and light material segments and by controlling the proportion of the total mass of the heavy material segments with respect to the total mass of the light weight material segments in the weight ring assembly will control the output force of a single model of the pneumatic vibrator.

18 Claims, 5 Drawing Sheets

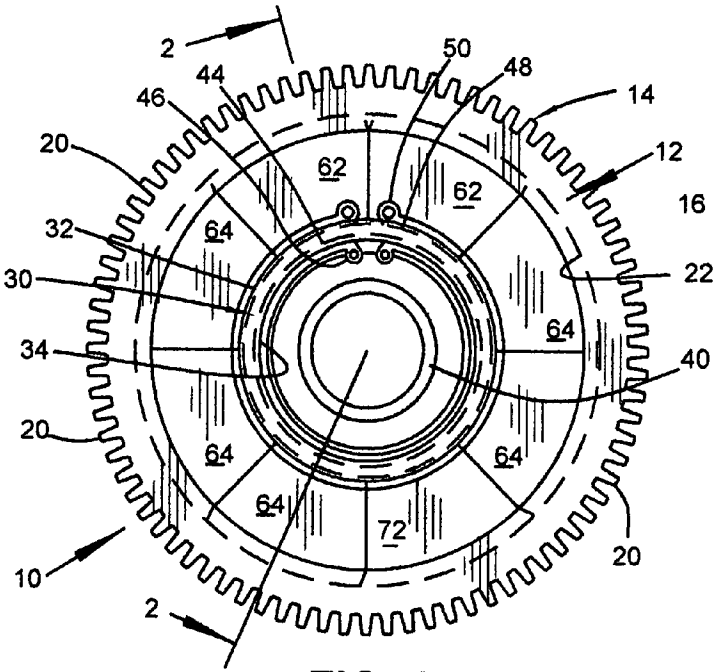
FIG. 1
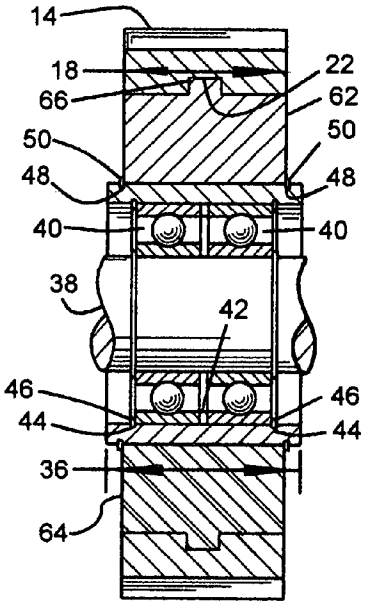
FIG. 2
FIG. 3
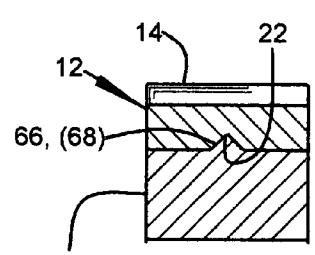
FIG. 4
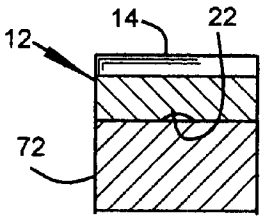
FIG. 5

TURBINE WHEEL ASSEMBLY FOR A PNEUMATIC ROTARY VIBRATOR AND METHOD OF MAKING SAME

CROSS REFERENCE TO RELATED APPLICATION

This application claims priority from U. S. Provisional Patent Application Ser. No. 61/201,895; filed on Dec. 16, 2008

BACKGROUND OF THE INVENTION

STATEMENT REGARDING FEDERALLY SPONSORED RESEARCH OR DEVELOPMENT

Not Applicable

FIELD OF THE INVENTION

With regard to the classification of art, this invention is believed to be found in the general class entitled Rotary Kinetic Fluid Motors Or Pumps and more particularly to those subclasses pertaining to a turbine wheel apparatus and methods for its assembly.

DESCRIPTION OF RELATED ART

Rotary vibrators are well known in the art. Some examples of the known rotary pneumatic vibrators are shown and described in U.S. Pat. No. 3,870,282 that issued to the present inventor on Mar. 11, 1975; and U.S. Pat. No. 3,932,057 that also issued to the present inventor on Jan. 13, 1976; and U.S. Pat. No. 3,938,905 that issued to the present inventor on Feb. 17, 1976. Each of these patents is included by reference into the present application.

Some of the applications for using a rotary vibrator require its mounting to the side of a bin, hopper or similar structure. The model selection and output force of a particular vibrator is usually determined by factory testing of a sample of the material that is intended to be stored in the bin, hopper or similar structure and subsequently dispensed with assistance of the vibrator. The housing of a rotary vibrator is usually removably mounted to the bin, hopper or similar structure in a predetermined position that may be located 20 feet or more above grounds level. Many times the actual material to be vibrated does not flow as determined by the test conducted on the sample material at the factory. Quite often the bin or hopper is filled at a later date with either a different material and/or density of material than was submitted for testing. In any of the situations mentioned above the original vibrator may not produce enough output force to keep the material moving in order for it to flow out of its bin or hopper. On the other hand the bin, hopper or similar structure may be damaged by stress fractures if the output force of the original vibrator is stronger than is actually needed for keeping the material moving.

It has been determined that there is a need for the end user of a rotary vibrator to be able to change the force output of that rotary vibrator without changing the housing of the installed particular model of vibrator and the resultant relocation of its mounting holes and piping. The present invention solves the identified need by providing a turbine wheel assembly that is constructed with a segmented weight ring assembly for allowing incremental changes to the output force of a particular size or model of rotary vibrator without the need of changing either the vibrator housing or the outside diameter of the turbine wheel. The turbine wheel assembly of the present invention may be either pre-assembled at the factory to save down time or may be assembled in the field according to a particular need.

SUMMARY OF THE INVENTION

The present invention may be briefly described as: a turbine wheel assembly for a pneumatic rotary vibrator that provides selectively adjustable force output while being removably retained on a vibrator shaft member mounted inside of a generally circular interior chamber of a housing of a single model of a pneumatic vibrator that includes: (a) a turbine ring having an outside diameter, an inside diameter and a predetermined thickness, the outside diameter being sized for rotation within the interior chamber of the pneumatic vibrator and further including a plurality of turbine teeth formed thereon, the inside diameter being substantially concentric with the outside diameter. (b) A sleeve member that is generally cylindrical and tubular in shape and includes an exterior surface and an interior bore. The sleeve member is adapted for being removably retained on the vibrator shaft member. The sleeve member may further include a pair of undercut annular retaining grooves having a selective and predetermined space there between on its exterior or outer surface. (c) A weight ring assembly that includes an outer circumference, an inner circumference, and a having a predetermined face width. The weight ring assembly includes a plurality of wedge shaped segments. The outer circumference of the weight ring assembly is formed by and with each wedge shaped segment while being sized for seating in the inside diameter of the turbine ring while the inner circumference formed by each of the wedge shaped segments mates with the outer surface of the sleeve member. The wedge shaped segments of the weight ring includes at least one heavy material segment and at least one lightweight material segment. The lightweight material segment is made of a suitable material that is lighter than the heavy material segment. (d) A means for retaining the weight ring assembly in the inside diameter of the turbine ring that may include either a tongue and groove arrangement and/or a structural adhesive. The weight ring may be retained on the sleeve member either by a structural adhesive and/or a pair of external retaining rings that are seated in the annular grooves in the exterior surface of the sleeve member. (e) Wherein controlling the proportion of the total mass of the heavy material segments with respect to the total mass of the light weight material segments in the weight ring will adjustably control the output force of the single model of the pneumatic vibrator after insertion and the removable retention of the turbine wheel assembly therein and the subsequent operation thereof.

The present invention may be also briefly described as: a method of making a turbine wheel assembly for a particular model of a pneumatic rotary vibrator that provides selectively adjustable force output while being removably retained on a portion of a vibrator shaft member that is mounted inferior of a generally circular interior chamber of a housing of the particular model of the pneumatic vibrator that includes the steps of: (1) providing a turbine ring having an outside diameter, an inside diameter and a predetermined thickness, the outside diameter being sized for rotation within the interior chamber of the pneumatic rotary vibrator and further including a plurality of turbine teeth formed thereon, the inside diameter being formed substantially concentric with the outside diameter; (2) providing a sleeve member that is generally cylindrical and tubular shaped and configured for being removably retained on the vibrator shaft member. The sleeve member may further include a pair of undercut retaining grooves having a selective and predetermined space there between on its exterior or outer surface; (3) providing a weight ring assembly that includes an outer circumference, an inner circumference, and having a predetermined face width, the weight ring assembly including a plurality of wedge shaped segments, the outer circumference of the weight ring assembly being formed by and with each wedge shaped segment while being sized for seating in the inside diameter of the turbine ring while the inner circumference formed by each of the wedge shaped segments mates with and is retained on the exterior or outer surface of the sleeve member by a suitable retaining means. The wedge shaped segments of the weight ring including at least one heavy material segment, and at least one light weight material segment. The light weight material segment being made of a suitable material that is lighter than the heavy material; (4) providing a means for retaining the weight ring assembly in the inside diameter of the turbine ring; (5) wherein controlling the proportion of the total mass of the heavy material segments with respect to the total mass of the light weight material segments in the weight ring will adjustably control the output force of the single model of the pneumatic vibrator after insertion and the removable retention of the turbine wheel assembly therein and the subsequent operation thereof.

The present invention lends itself to its removable retention on either a dead vibrator shaft or a live vibrator shaft.

In addition to the above summary, the following disclosure is intended to be detailed to insure adequacy and aid in the understanding of the invention. However, this disclosure, showing particular embodiments of the invention, is not intended to describe each new inventive concept that may arise. These specific embodiments have been chosen to show at least one preferred or best made for the present invention. These specific embodiments, as shown in the accompanying drawings, may also include diagrammatic symbols for the purpose of illustration and understanding.

BRIEF DESCRIPTION OF THE DRAWING

FIG. 1 represents a front elevation of a first embodiment of a turbine wheel assembly of the present invention.

FIG. 2 represents a side elevation of the present invention, this view being taken along line 2-2 of FIG. 1 and showing one means for retaining the weight ring therein. This means for retaining the weight ring employs a first contour for its tongue and groove.

FIG. 3 represents another means for retaining the weight ring of FIG. 2 therein. This particular means for retaining the weight ring employs a second contour for the tongue and groove.

FIG. 4 represents still another means for retaining the weight ring of FIG. 2 therein. This particular means for retaining the weight ring employs a third contour for the tongue and groove.

FIG. 5 represents yet still another means for retaining the weight ring of FIG. 2 therein. This particular means for retaining the weight ring employs a fourth contour for the tongue and groove.

FIG. 13(*b*) represents the second step of seating the first segment into the inside diameter of the turbine ring.

FIG. 13(*c*) represents the third step of placing a second segment into the interior of the turbine ring.

FIG. 13(*d*) represents the fourth step of seating the second segment into the inside diameter of the turbine ring.

FIG. 13(*e*) represents the fifth step of sliding the second segment clockwise to abut the end of the first segment while being seated into the inside diameter.

FIG. 13(*f*) represents the sixth step of placing a third segment into the interior of the turbine ring.

FIG. 13(*g*) represents the seventh step of seating the third segment into the inside diameter of the turbine ring and rotating it clockwise to abut the end of the second segment.

FIG. 13(*h*) represents the eighth step of inserting a filler segment interior of the turbine ring so that it simultaneously is abutting the inside diameter of the turbine ring and the exposed ends of the first segment and the third segment.

Figure 7:
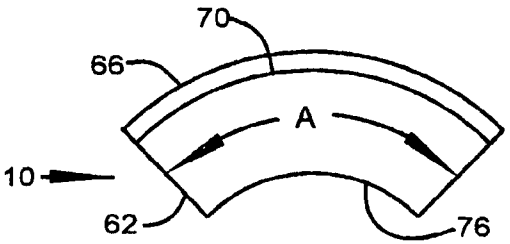
FIG. 7 represents a front elevation of a heavy weight segment.

In the following description and in the appended claims, various details are identified by specific names for convenience. These names are intended to be generic in their application while differentiating between the various details. The corresponding reference numbers refer to like members throughout the several figures of the drawing.

The drawings accompanying and forming a part of this specification disclose details of construction for the sole purpose of explanation. It is to be understood that structural details may be modified without departing from the concept and principles of the invention as claimed. This invention may be incorporated into other structural forms than shown.

DETAILED DESCRIPTION OF THE INVENTION

THE FIRST EMBODIMENT

Referring first to FIGS. 1 through 9, the turbine wheel assembly of the present invention is generally identified as 10 and includes a turbine ring 12. The turbine ring 12 may be more clearly seen in FIGS. 1, 2 and 6 and includes an outside diameter 14, an inside diameter 16, and has a predetermined depth or thickness 18. The outside diameter 14 and its depth or thickness 18 are sized to fit closely within an interior chamber of a rotary vibrator housing, that is not shown, while simultaneously allowing its rotation therein. Turbine teeth 20 are formed completely along the outside diameter 14 of the turbine ring 12. An undercut groove 22 is formed into the inside diameter 16 of the turbine ring 12. The inside diameter 16 is substantially concentric with the outside diameter 14. This undercut groove 22 will be discussed below. It is preferred that the turbine ring 12 be formed of a lightweight metal. One non-limiting example of a lightweight material is aluminum. The turbine teeth 20 and the inside diameter 16 of the turbine ring 12 may be formed and supplied in elongated lengths by an extrusion process with the thickness 18 and undercut groove 22 being formed at the factory by a subsequent machining operation.

Referring now to FIGS. 1 and 2, the turbine wheel assembly 10 further includes a sleeve member 30 that is generally cylindrical and tubular shaped. The sleeve member 30 is elongated and includes an exterior surface 32, an interior bore 34, and a predetermined length 36. In this first embodiment of the turbine wheel assembly 12 the sleeve member 30 is configured for mounting on a dead shaft 38 of a rotary vibrator. A dead or stationary shaft 38 means there is relative rotational motion between the shaft 38 and turbine wheel assembly 12, as may be seen in U.S. Pat. No. 3,870,282, therefore the interior bore 34 is concentric with the exterior surface of the sleeve member 30 and is sized for the mounting of a pair of anti-friction bearings 40 therein. It is preferred that a bearing spacer 42 be placed between the outer races of the anti-friction bearings 40 for providing a predetermined bearing spacing on the shaft 38. However it is anticipated that a single anti-friction double row ball or roller bearing may be used. The interior bore 34 preferably includes a pair of undercut retaining grooves 44 that are selectively spaced and sized for the seating of a pair of first internal retaining rings 46 therein while retaining the anti-friction bearings within the bore 34 of the sleeve member 30. The first internal retaining rings 46 may be of the commercially available spring type.

Figure 8:
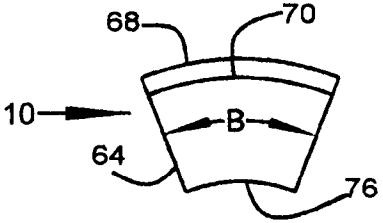
FIG. 8 represents a front elevation of a lighter weight segment.
Figure 9:
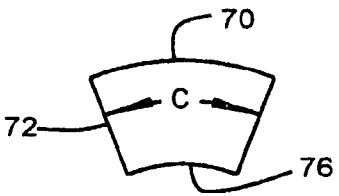
FIG. 9 represents a front elevation of a weight segment that is used as a filler segment.
Figure 10:
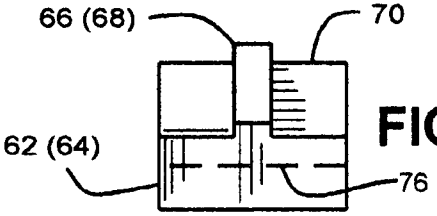
FIG. 10 represents a side elevation of either of the weight segments having a tongue-like protrusion. This view has been taken in the direction of arrow 10 of FIG. 7 or 8.
Figure 6:
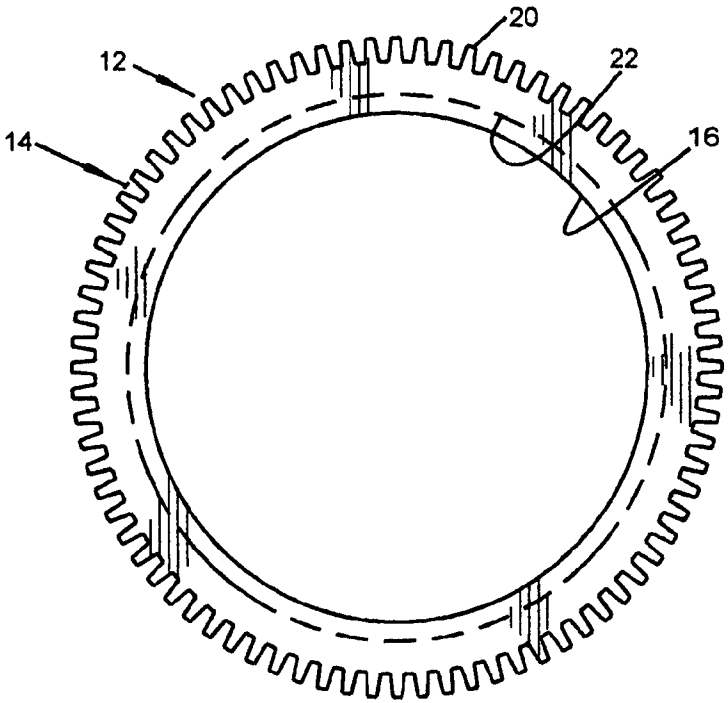
FIG. 6 represents a front elevation view of a turbine ring of the present invention.

Referring now to FIGS. 1, 2 and 7 through 10, the weight ring assembly 60 of the first embodiment of the turbine wheel assembly 12 includes a plurality of wedge shaped or arc like segments. At least one of the wedge shaped segments is made of a heavy material and identified as 62 in FIG. 7. Some non-limiting examples of a heavy material segments 62 are: steel, cast iron, brass and stainless steel. It has been found that the included angle identified as "A" of the heavy material segments 62 may range between 10 arc degrees and 90 arc degrees for ease of assembly. It is also preferred that the included angle "A" of the heavy segment be divisible into 360 arc degrees by a whole number. The other wedge shaped segments forming the weight ring assembly 60 should be made of a material that is a lighter density than the heavy material segments 62. These lighter density segments are seen in FIG. 8 and identified as 64. It has also been found that the included angle identified as "B" of the lighter density material should also be in the range between 10 arc degrees and 90 degrees for ease of assembly. Some examples of lighter density materials that may be used are aluminum, thermo-plastics, etc. The heavy material segments 62 and the lighter density material segments 64 in this first embodiment 10 of the present invention include a retaining means in the formed by a tongue member 66 and 68 that is concentric with the outer arc surface 70 of each of the segments 62 and 64 respectively. The profile of these tongues 66 and 68 are sized and shaped to seat into the undercut groove 22 formed into the turbine ring 12. It is to be noted that one non-limiting example for the tongue 66 has been disclosed in FIGS. 2 and 10 other possible non-limiting examples of tongue 66 and mating undercut grooves 22 are shown in FIGS. 3, and 4. It has been found that when a tongue 66 and undercut groove 22 arrangement is used for a majority of the wedge segments of the weight ring assembly 60 that it is necessary to provide and install at least one filler wedge segment 72 that does not have a tongue formed on it. This filler segment 72 as depicted in FIGS. 5 and 9 acts as a keystone and is needed to complete the weight ring assembly after all the segments 62 and 64 have been seated into turbine ring 12. FIG. 5 also shows another possible shape for the undercut grove 22 of the turbine ring. It is preferred that the filler segment 72 be made of a light density material similar to wedge 64 but in some applications the filler segment 72 may be made of a material similar to heavy segment 62.

An outer circumference 74 of the weight ring assembly 60 is formed by the outer arc surface 70 of all of the wedge segments that are needed to complete the weight ring assembly 60. This outer circumference 74 is sized to closely mate with the inside diameter 16 of the turbine ring 12. An inner circumference 76 formed by the assembled wedge segments 62, 64 and 72 is sized and shaped to receive the outer surface 32 of the sleeve member 30. Referring now to FIG. 2, each of the first external retaining rings 50 is installed in their respective annular grooves 48 after the sleeve member 30 is correctly aligned with the turbine ring 12 and weight ring assembly 60.

This first embodiment of the turbine wheel assembly 10 lends itself to being completely assembled in a factory in a short time and shipped or delivered to the end user for installation in a previously purchased and installed model of a rotary vibrator housing that is installed on a structure such as a bin or hopper. The replacement of the wheel assembly 10 is necessary after it has been determined that the original output force of that vibrator is not matched to the needed flow characteristics of the material being dispensed.

This first embodiment of the turbine wheel assembly 10 may also be modified by the end user at the work site as needed due to the fact that all its components are removably retained therein and thereon. It can be seen that field disassembly of a turbine wheel assembly of a rotary vibrator would not be very difficult. It also can be seen that reassembly of the turbine wheel assembly 10 is possible with a modified output force by controlling the proportion of the total mass of the heavy material segments 62 with respect to the total mass of the lighter density segments 64 of the weight ring assembly 60. The position of the filler segment 72 in the weight ring assembly 60 is determined by the type of material used in the construction of that filler segment 72 and abutting a segment of a similar material.

THE SECOND EMBODIMENT

Figure 12:
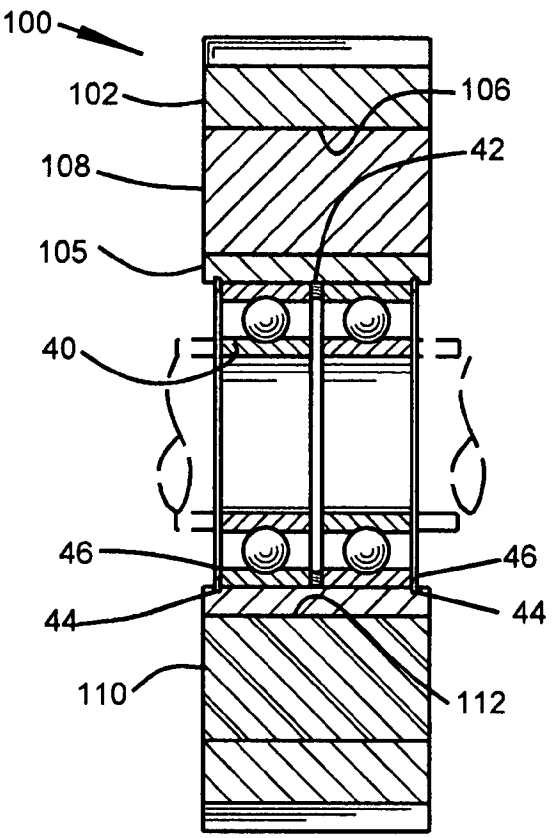
FIG. 12 represents a side elevation of the present invention depicted in FIG. 11. This view has been taken along line 12-12 of FIG. 11.
Figure 11:
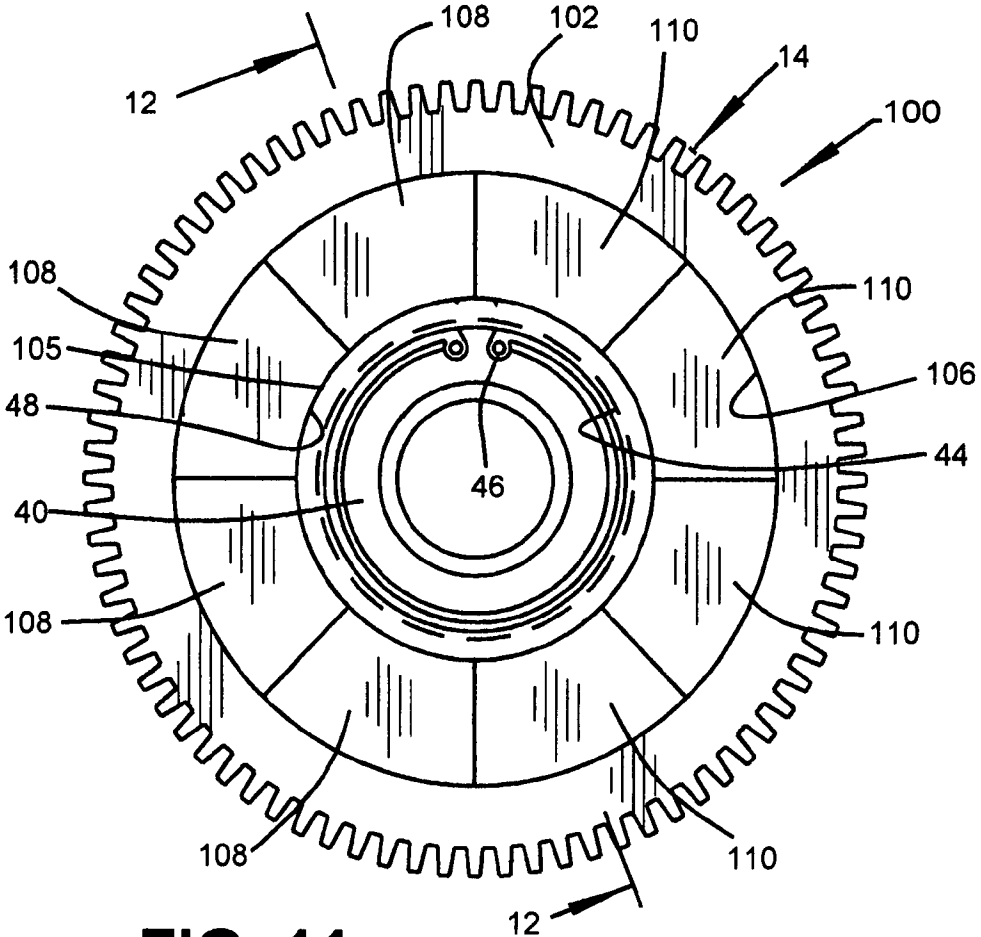
FIG. 11 represents a front elevation of a second embodiment of a turbine wheel assembly of the present invention. The means for retaining in this embodiment is a structural adhesive.
Figure 13A:
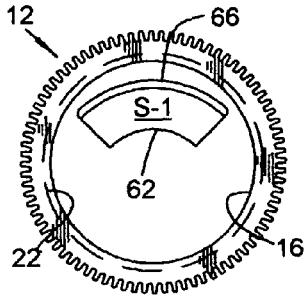
FIG. 13(*a*) represents the first step of placing a first segment into the interior of the turbine ring.
Figure 13B:
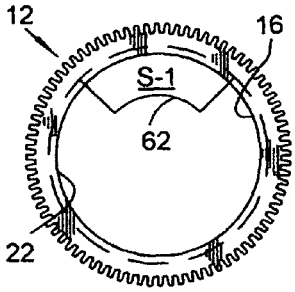
Figure 13C:
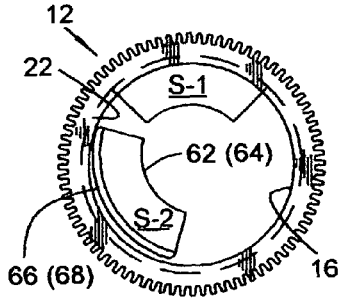
Figure 13D:
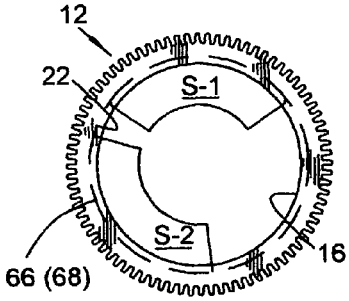
Figure 13E:
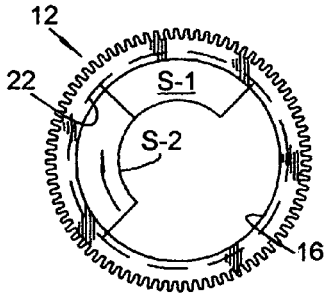
Figure 13F:
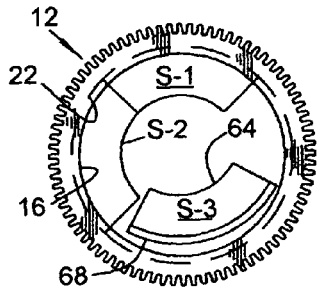
Figure 13G:
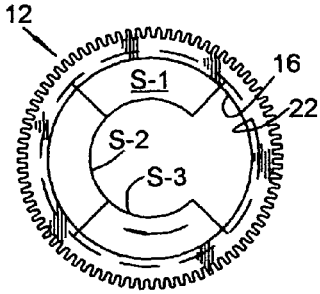
Figure 13H:
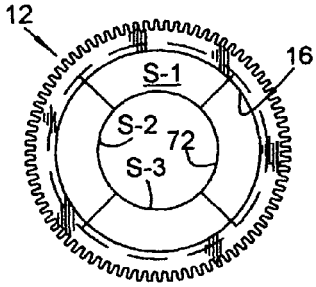

Referring now to FIGS. 11 and 12 a second embodiment of a turbine wheel assembly is generally identified as 100. This turbine wheel assembly 100 is similar to the turbine wheel assembly 10. Turbine wheel assembly 100 includes a turbine ring 102, a weight ring assembly 104, and sleeve member 105. The turbine ring 102 is similar to turbine ring 12 and also includes an outside diameter 14, an inside diameter 106, and has a predetermined face width or depth or thickness 18. The outside diameter 14 and its depth or thickness 18 are sized to fit closely within the interior chamber of a rotary vibrator housing, not shown, while simultaneously allowing its rotation therein with minimal dimensional run out or eccentricity. Turbine teeth 20 are also formed completely along the outside diameter 14 of the turbine ring 12. The main difference between turbine ring 102 and turbine ring 12 is that its inside diameter 106 is absent an undercut groove. The turbine ring 102 may be manufactured or machined from the same extruded material as turbine ring 12.

The sleeve assembly 105 is similar to sleeve member 30 that has been described above in connection with the first embodiment 10 with the exception that the external annular groves 48 are absent. The sleeve member 30 has been described in detail above in connection with the first embodiment.

The weight ring assembly 104 is similar to weight ring assembly 60 with the exception that all the heavy material segments 108 and the lighter density segments 110 are formed absent the tongues 66 and 68 respectively. Basically the heavy material segments 108 and the light density 110 segments are contoured like the filler segment 72 of the first embodiment 10 while having their included angles "C", as seen in FIG. 9 being between 10 arc degrees and 180 arc degrees. Each of the heavy material segments 108 and lighter density segments 110 are individually placed interior the inside diameter 106 of the turbine ring 102 to form the weight ring assembly 104. It has been found that applying a thin coating of an structural epoxy resin or adhesive first to the inside diameter 106 of the turbine ring 102 that has been cleaned of foreign matter will retain the individual segments 108 and 110. This thin coating retains the seated segments during the insertion of the remaining segments for completing the assembly of the weight ring and prior to the insertion of the sleeve assembly 105 into the inner circumference 112 of the weight ring. In a similar manner it has been found that applying a thin coating of the structural epoxy resin or adhesive to the inner circumference of the weight ring assembly that has been properly cleaned of foreign matter prior to the insertion and alignment of the sleeve member 105 with the weight ring assembly 104 will retain the sleeve member 105 therein. The structural epoxy resin or adhesive will suitably retain all the cleaned and assembled components after its curing time has elapsed. This construction has also been found suitable for operation of the turbine wheel assembly in a rotary vibrator.

Referring now to FIGS. 1 and 11, it also can be easily seen that the output force for the turbine wheel assembly 10 and 100 may be modified by controlling the proportion of the total area of the heavy material segments 62 or 108 with respect to the total area of the lighter density segments 64 or 110.

DESCRIPTION OF FIGS. 13(*a*) THROUGH 13(*h*)

One non-limiting example for assembling the turbine wheel assembly 10 is described as follows: these steps are described with the turbine ring 12 in a horizontal position and each of the segments having an included angle "A" or "B" of 90 arc degrees. FIG. 13(*a*) represents the first step of placing a first segment S-1 selected from the heavy material segments 62 into the interior space defined by the inside diameter 16 of the turbine ring 12 so that its tongue 66 is facing towards the inside diameter 16.

FIG. 13(*b*) represents the second step of moving the first heavy material segment S-1 towards the inside diameter 16 of the turbine ring 12 so that its tongue 66 engages the undercut groove 22.

FIG. 13(*c*) represents the third step of selectively choosing a second segment S-2 from either the heavy material segments 62 or a light material segments 64 and placing it into the interior space defined by the inside diameter 16 of the turbine ring 12 so that its tongue 66 or 68 is facing towards the inside diameter 16

FIG. 13(*d*) represents the fourth step of seating the second segment S-2 into the inside diameter 16 of the turbine ring 12 so that its tongue 66 or 68 is seated in the undercut groove 22. It is to be noted that in this example if the second segment S-2 is a heavy material segment 62 then it most likely is the last to be used in this turbine wheel assembly 10.

FIG. 13(*e*) represents the fifth step of sliding the second segment S-2 clockwise to abut the exposed end of the first segment S-1.

FIG. 13(*f*) represents the sixth step of placing a third segment S-3 selected from the lighter material segments 64 into the interior of turbine ring so that its tongue 68 is facing towards the inside diameter 16

FIG. 13(*g*) represents the seventh step of seating the third segment S-3 into the inside diameter 16 of the turbine ring 12 and rotating it clockwise to abut the end of the second segment S-2.

FIG. 13(*h*) represents the eighth step of inserting a filler segment 72 interior of the turbine ring 12 so that it simultaneously is abutting the inside diameter 16 of the turbine ring 12 and the exposed ends of the first segment S-1 and the third segment S-3.

Referring now to FIGS. 1 and 2 the sleeve member 30 is inserted into the inner circumference 76 formed by the assembled wedge segments S-1, S-2, S-3 and 72 so its outer surface 32 is seated therein. Each of the first external retaining rings 50 may be installed in their respective annular grooves 48 after the sleeve member 30 is correctly aligned with the turbine ring 12 and weight ring assembly 60.

It should be noted that four segments S-1, S-2, S-3, and 72 have been used in connection with the above description associated with FIG. 13(*a*) through 13(*h*) to form the weight ring. The included angle "A", "B", or "C" of each of these segments is nominally 90 arc degrees. The 90 degree included angle of the segments has been chosen for ease of illustration and explanation. It is to be noted that the nominal Included angles "A", "B", or "C" should include a small allowance for fitting together to form the weight ring. The maximum vibratory output force of the turbine wheel assembly 10 or 110 is attained when the heavy material segments occupy 180 continuous arc degrees or one-half the segment area of the weight ring assembly. When two 90 arc degree segments are used in the assembly of the weight ring the original output force may be reduced once by removing one of the two heavy material segments and replacing it with a lighter weight segment of 90 degrees. On the other hand if all the 180 degree area of the heavy material segments that were installed in the original turbine wheel assembly have an included angle of 10 degrees then it is possible to make a total of 17 variations to the output force of the turbine wheel assembly by removing each individually and substituting a lighter weight segment with the same included angle.

DESCRIPTION OF FIGS. 14 AND 15

Figure 15:
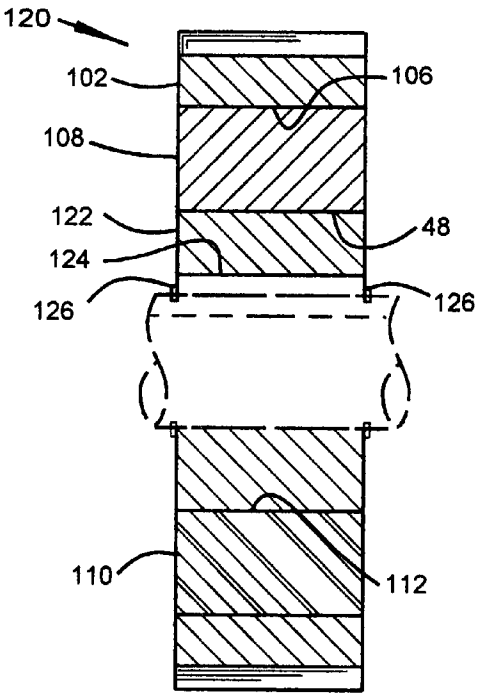
FIG. 15 represents a side elevation of the present invention depicted in FIG. 14. This view has been taken along line 15-15 of FIG. 14.
Figure 14:
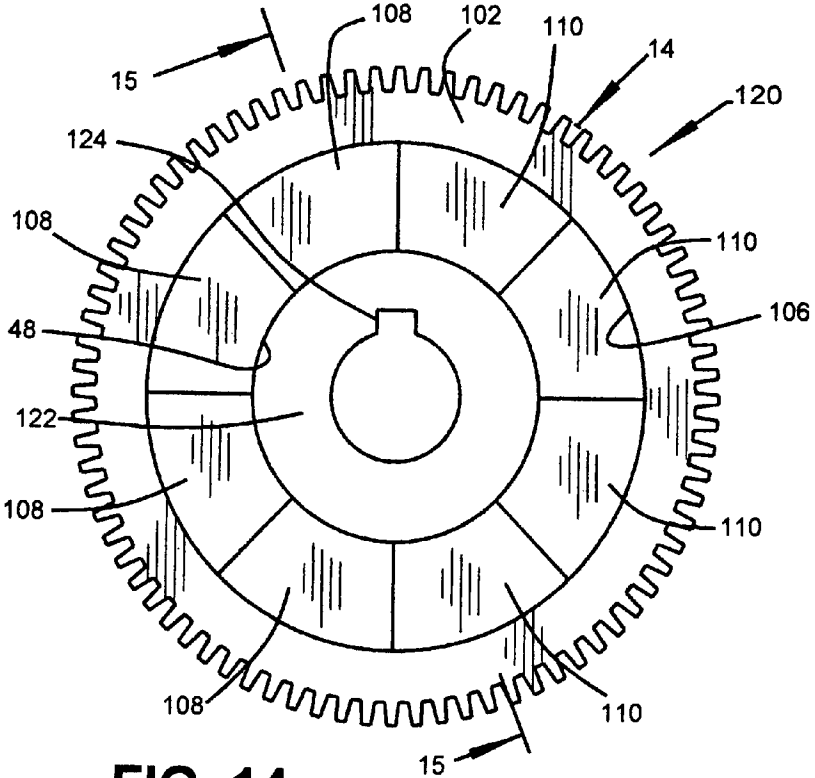
FIG. 14 represents a front elevation of a third embodiment of a turbine wheel assembly of the present invention for use with a live shaft.

Referring now to FIGS. 14 and 15, the third embodiment of the turbine wheel assembly of the present invention generally identified as 120 is similar to the second embodiment 100 and includes many of the same components. This third embodiment 120 may be mounted on a live shaft by replacing the assembled sleeve 30 and anti friction bearings 40 of turbine wheel assembly 100 with a sleeve member or drive hub 122 that includes a keyway 124 and is retained in the weight ring in a like manner as sleeve 30. The third embodiment 120 is removably retained on the live shaft that is shown in dashed outline and has a key and key seat arrangement, The third embodiment 120 is removably retained on the live shaft by and with a pair of spaced snap rings 126 that are seated in spaced snap ring grooves that are machined into the live shaft. It is to be noted that alternatively the spaced snap rings may be replaced with a pair of tubular spacers, not shown, between the ends of the sleeve member 122 and a pair of vibrator shaft ant-friction bearings mounted in the bearing caps of the vibrator housing. The anti-friction bearings and the vibrator housing have not been shown.

The first embodiment 10, the second embodiment 100 and the third embodiment 120 of the present invention described above also suggests the method of making a turbine wheel assembly for a pneumatic rotary vibrator that provides selectively adjustable force output while being removably retained on a vibrator shaft member mounted interior of a generally circular interior chamber of a housing of a single model pneumatic vibrator that includes the steps of:

(1) providing a turbine ring 10 having an outside diameter 14, an inside diameter 16 and a predetermined thickness 18, the outside diameter 14 being sized for rotation within the interior chamber of a pneumatic rotary vibrator and further including a plurality of turbine teeth 14 formed thereon, the inside diameter 16 being substantially concentric with the outside diameter 14.

(2) providing a sleeve member 30 that is generally cylindrical and tubular shaped and configured for being removably retained on the vibrator shaft member; its interior bore and its outer surface are formed concentrically;

(3) providing a weight ring assembly 60 that includes an outer circumference 74, an inner circumference 76, and a having predetermined face width, the weight ring assembly 60 including a plurality of wedge shaped segments 62, 64 & 72, the outer circumference 74 of the weight ring assembly 60 being formed by and with each wedge shaped segment while being sized for seating in the inside diameter 16 of the turbine ring 12 while the inner circumference 76 formed by each of the wedge shaped segments mates with the exterior or outer surface 32 of the sleeve member 30, the wedge shaped segments of the weight ring assembly 60 including at least one heavy material segment 62, a plurality of light weight material segments 64 and 72 being made of a suitable material that is lighter than the heavy material 62.

(4) providing a means for retaining the weight ring assembly 60 in the inside diameter 16 of the turbine ring 12.

(5) providing a means for retaining the outer surface of the sleeve member in the inner circumference of the weight ring assembly 60.

(6) wherein controlling the proportion of the total mass of the heavy material segments 62 with respect to the total mass of the light weight material segments 64 and 72 in the weight ring assembly will adjustably control the output force of the single pneumatic vibrator.

It is preferred that in all of the above embodiments that the turbine wheel rings, the weight ring assemblies and the sleeve members be formed or machined in a concentric manner for providing minimal dimensional run out or eccentricity during rotation of the turbine wheel assemblies within the vibrator housings.

Directional terms such as "front", "back", "in", "out", downward, upper, lower and the like may have been used in the description. These terms are applicable to the embodiments shown and described in conjunction with the drawings. These terms are merely used for the purpose of description in connection with the drawings and do not necessarily apply to the position in which the present invention may be used.

While these particular embodiments of the present invention have been shown and described, it is to be understood that the invention is not limited thereto and protection is sought to the broadest extent that the prior art allows.

What is claimed is:

1. A method of making a turbine wheel assembly for a pneumatic rotary vibrator that provides a selectable force output and being removably retained on a vibrator shaft member, the vibrator shaft member being mounted in a generally circular interior chamber of a housing of a pneumatic vibrator that includes the steps of:

a) providing a turbine ring having an outside diameter, an inside diameter and a predetermined thickness, the outside diameter being sized for rotation within the interior chamber of the pneumatic vibrator and further including a plurality of turbine teeth formed thereon, the inside diameter being substantially concentric with the outside diameter, the turbine ring also being formed as a singular unit from a single rigid material;

b) providing a sleeve member having a selectively sized cylindrical exterior surface, an interior bore and a predetermined length, the interior bore being concentric with the cylindrical exterior surface;

c) providing a weight ring assembly that includes an outer circumference, an inner circumference, and a predetermined face width, the weight ring assembly including a plurality of wedge shaped segments, the outer circumference of the weight ring assembly being formed by and with each wedge shaped segment while being sized and contoured for its sequential insertion and abutted seating of the wedge shaped segments in the inside diameter of the turbine ring while the inner circumference formed by each of the wedge shaped segments mates with the cylindrical exterior surface of the sleeve member, the wedge shaped segments of the weight ring including at least one heavy material segment, and at least one light weight material segment, the light weight segment being made of a suitable material that is lighter than the heavy material segment;

d) providing a means for retaining the outer circumference of the weight ring assembly to the inside diameter of the turbine ring;

e) providing a means for retaining the inner circumference of weight ring assembly to the cylindrical exterior surface of the sleeve member;

(f) wherein, controlling the proportion of the total mass of the at least one heavy material segment with respect to the total mass of the at least one light weight material segment in the weight ring will adjustably control the output force of the pneumatic vibrator after insertion and the removable retention therein and operation thereof, the weight ring assembly and the sleeve member being removably retained and supported by the rigid material of the turbine ring while providing minimal dimensional eccentricity during rotation of the turbine wheel within its housing.

2. The method as recited in claim 1 wherein the means for retaining the outer circumference of the weight ring assembly to the inside diameter of the turbine ring includes the further step of applying a thin coating of a structural adhesive to the inside diameter of the turbine ring prior to the sequential insertion and abutted seating of each of the wedge shaped segments of the weight ring assembly therein.

3. The method as recited in claim 2 wherein the means for retaining the inner circumference of weight ring assembly to the cylindrical exterior surface of the sleeve member includes the further step of applying a thin coating of a structural adhesive to the inner circumference of the weight ring prior to the seating of the sleeve member therein.

4. The method as recited in claim 1 which includes the further step of: providing at least one anti-friction bearing that is sized for being seated in the interior bore of the sleeve member, an inner bore of the at least one anti-friction bearing is sized for being removably mounted on the vibrator shaft member and; wherein the vibrator shaft member is non-rotational with respect to the housing of the pneumatic vibrator when in operation.

5. The method as recited in claim 2 which includes the further step of: providing at least one anti-friction bearing that is sized for being seated in the interior bore of the sleeve member, an inner bore of the at least one anti-friction bearing is sized for being removably mounted on the vibrator shaft member and; wherein the vibrator shaft member is non-rotational with respect to the housing of the pneumatic vibrator when in operation.

6. The method as recited in claim 4 which includes the further step of: providing at least two undercut retaining ring grooves that are selectively spaced apart while being annularly cut into the interior bore of the sleeve member for retaining the at least one anti-friction bearing there-between by and with a pair of spring type first internal retaining rings.

7. The method as recited in claim 5 which includes the further step of: providing at least two undercut retaining ring grooves that are selectively spaced apart while being annularly cut into the interior bore of the sleeve member for retaining the at least one anti-friction bearing there-between by and with a pair of spring type first internal retaining rings.

8. The method as recited in claim 1 which includes the further steps of:

a) sizing the interior bore of the sleeve member for being closely and removably mounted on the vibrator shaft member;

b) providing a driving means between the sleeve member and the vibrator shaft member, and:

wherein the turbine wheel assembly and the vibrator shaft member are rotationally driven with respect to the housing of the pneumatic vibrator when in operation.

9. The method as recited in claim 8 wherein the step of providing a driving means between the sleeve member and the vibrator shaft member further includes the step of forming a keyway into the interior bore of the sleeve member for mating with a key inserted into the vibrator shaft member.

10. A turbine wheel assembly for a pneumatic rotary vibrator that provides a selectable force output while being removably retained on a vibrator shaft member mounted inside of a generally circular interior chamber of a housing of a pneumatic vibrator that includes:

a) a turbine ring having an outside diameter, an inside diameter and a predetermined thickness, the turbine ring being formed as a singular unit of a rigid metal material, the outside diameter being sized for rotation within the interior chamber of the pneumatic vibrator and further including a plurality of turbine teeth formed thereon, the inside diameter being substantially concentric with the outside diameter, the inside diameter having a groove formed therein, the groove being undercut and having a predetermined depth and profile;

(b) a sleeve member having a selectively sized cylindrical exterior surface, an interior bore and a predetermined length, the interior bore being concentric with the cylindrical exterior surface;

(c) a weight ring assembly that includes an outer circumference, an inner circumference, and a having a predetermined face width, the weight ring assembly including a plurality of wedge shaped segments, the outer circumference of the weight ring assembly being formed by and with each wedge shaped segment while being sized for seating in the inside diameter of the turbine ring while the inner circumference formed by each of the wedge shaped segments mates with the cylindrical exterior surface of the sleeve member, the wedge shaped segments of the weight ring including at least one heavy material segment and a plurality of light weight material segments, the light material segments being made of a suitable material that is a lighter density than the heavy material segment, the weight ring assembly further including a tongue member that is formed integrally along a selected portion of its outer circumference and concentric therewith, the at least one heavy material segment having a first segment of the tongue member integrally formed along its outer arc surface, the outer arc surface forming a portion of the outer circumference of the weight ring assembly, the first segment of the tongue member projecting outwardly from the outer arc surface and having a predetermined profile for seating in the groove of the turbine ring, and a majority of the light weight segments having a second segment of the tongue member integrally formed along its outer curved surface, the outer curved surface also forming a portion of the outer circumference of the weight ring assembly, the second segment of the tongue member project outwardly and concentrically from the outer curved surface while having a predetermined profile that is similar to the first segment of the tongue member for seating in the groove of the turbine ring while being formed integrally therewith, at least one of the light weight material segments being absent the second tongue segment for acting as a keystone segment after the balance of the heavy material segments and the light weight material segments have been inserted and seated and abutted interior of the turbine ring and prior to the insertion of the sleeve member therein;

(d) a means for retaining the weight ring assembly in the inside diameter of the turbine ring;

(e) a means for retaining the exterior surface of the sleeve member to inner circumference of the weight ring assembly; and (f) wherein controlling the proportion of the total mass of the heavy material segments with respect to the total mass of the light weight material segments in the weight ring will adjustably control the output force of a model of the pneumatic vibrator the weight ring assembly and the sleeve member being removably retained and supported interior of the rigid metal material of the turbine ring for providing minimal dimensional eccentricity during rotation of the turbine wheel within its housing.

11. The turbine wheel assembly as recited in claim 10 that further includes at least one anti-friction bearing that is seated in an interior bore of the sleeve member and an inner bore of the at least one anti-friction bearing is sized for being removably mounted on the vibrator shaft member and; wherein the vibrator shaft member is non-rotational with respect to the housing of the pneumatic vibrator when in operation.

12. The turbine wheel assembly as recited in claim 11 that further includes at least two undercut retaining ring grooves that are selectively spaced apart while being annularly cut into the interior bore of the sleeve member for retaining the at least one anti-friction bearing there-between by and with a pair of spring type first internal retaining rings.

13. The turbine wheel assembly as recited in claim 10 that further includes an interior bore of the sleeve member being sized for closely and removably mounting on the vibrator shaft member and the inner bore further including a driving means between the sleeve member and the vibrator shaft member, and wherein the turbine wheel assembly and the vibrator shaft member are rotationally driven with respect to the housing of the pneumatic vibrator when in operation.

14. The turbine wheel assembly as recited in claim 13 wherein the driving means between the sleeve member and the vibrator shaft member further includes a keyway formed into the interior bore of the sleeve member for mating with a key inserted into the vibrator shaft member.

15. The turbine wheel assembly as recited in claim 10 wherein the means for retaining the exterior surface of the sleeve member to inner circumference of the weight ring assembly includes a pair of annular grooves, each of the annular grooves having a selective and a predetermined space there between on the exterior surface of the sleeve member that allows the predetermined face width of the weight ring to be retained there between by and with an external retaining ring seated in each of the annular grooves.

16. The turbine wheel assembly as recited in claim 11 wherein the means for retaining the exterior surface of the sleeve member to inner circumference of the weight ring assembly includes a pair of annular grooves, each of the annular grooves having a selective and a predetermined space there between on the exterior surface of the sleeve member that allows the predetermined face width of the weight ring to be retained there between by and with an external retaining ring seated in each of the annular grooves.

17. The turbine wheel assembly as recited in claim 10 wherein the means for retaining the exterior surface of the sleeve member to inner circumference of the weight ring assembly includes applying a thin coating of a structural adhesive there between.

18. The turbine wheel assembly as recited in claim 15 wherein the groove formed into the inside diameter of the turbine wheel and the first and second segments of the tongue member are aligned and seated therein for centrally positioning the weight ring assembly within the predetermined thickness of the turbine ring.

* * * * *